United States Patent [19]

Schexnayder

[11] Patent Number: 4,586,332

[45] Date of Patent: May 6, 1986

[54] HYDRAULIC SWING MOTOR CONTROL CIRCUIT

[75] Inventor: Lawrence F. Schexnayder, Joliet, Ill.

[73] Assignee: Caterpillar Tractor Co., Peoria, Ill.

[21] Appl. No.: 672,723

[22] Filed: Nov. 19, 1984

[51] Int. Cl.[4] ..... F15B 13/042

[52] U.S. Cl. ..... 60/468; 60/493; 60/494

[58] Field of Search ..... 60/468, 493, 494

[56] References Cited

U.S. PATENT DOCUMENTS

| | | | |
|---|---|---|---|
| 3,490,606 | 1/1970 | Gordan | 212/66 |
| 4,194,365 | 3/1980 | Stoufflet et al. | 60/468 |
| 4,481,770 | 11/1984 | Lohbauer et al. | 60/468 X |

*Primary Examiner*—Gerald A. Michalsky
*Attorney, Agent, or Firm*—John W. Grant

[57] ABSTRACT

Hydraulic motors are conventionally employed in rotating the upper structure of excavators and the like. Protection from inertia induced hydraulic shock loads of some hydraulic control circuits involves the use of a separate bypass valve which continuously interconnects the motor conduits. The subject control circuit includes a pair of shunt valves each of which establishes restricted communication between the first and second motor conduits in a particular direction at their normal spring biased position. This allows limited free swing of the upper structure when the directional control valve is shifted from an operating position to the neutral position. However, shifting the directional control valve to an operating position causes the appropriate one of the shunt valves to shift to a blocking position so that no interconnection between the motor conduits exist. Thus, the disclosed control circuit causes all pressurized fluid directed into one of the motor conduits to be transmitted to the hydraulic motor for maximum efficiency.

6 Claims, 2 Drawing Figures

HYDRAULIC SWING MOTOR CONTROL CIRCUIT

DESCRIPTION

1. Technical Field

This invention relates generally to a hydraulic swing motor control circuit for an excavator or the like and more particularly to a circuit providing restricted free swing for deceleration control.

2. Background Art

The rotatable upper structure of many vehicles such as excavators and the like is rotated by a hydraulic swing motor controlled by a directional control valve. Because of the large mass and the geometry of the upper structures, high inertia loads are generated in the upper structure when it is rotated. Such inertia loads must be absorbed by the swing motor and/or hydraulic circuit when the upper structure is brought to a stop.

Many devices have been employed in the hydraulic circuit of such vehicles to prevent or minimize inertia induced hydraulic shock loads on the various parts of the vehicle and the hydraulic circuit. One such example is disclosed in U.S. Patent No. 3,490,606 which issued on Jan. 20, 1970 to Richard O. Gordon. The control system of that patent includes an adjustable bypass valve in the hydraulic circuit to permit free swing of the upper body after the directional control valve is shifted to the neutral or blocking position. The bypass valve can be dialed by the vehicle operator to provide controlled free swing or swing deceleration. However, that bypass valve interconnects the motor lines at all times and could cause some operating problems under certain conditions. For example, when the pressurized fluid is being metered to one side of the motor at a low flow rate for rotating the upper structure very slowly, the pressurized fluid can pass through the bypass valve to the other side of the motor thereby resisting the rotation of the motor. The directional control valve would then have to be actuated to a greater degree to increase the pressure to the one side of the motor thereby causing the hydraulic pump to work against higher and higher pressures.

The present invention is directed to overcoming one or more of the problems as set forth above.

DISCLOSURE OF THE INVENTION

In one aspect of the present invention a control circuit has a hydraulic motor, a pump, a directional control valve connected to the pump, and first and second motor conduits connecting the control valve with opposite sides of the hydraulic motor. The control valve is movable between a first position at which pressurized fluid from the pump is directed through the first motor conduit to the motor and a second position at which pressurized fluid from the pump is directed through the second motor conduit to the motor and has an intermediate neutral position at which the pump is blocked from the first and second motor conduits. A first shunt valve is connected between the first and second motor conduits and is movable between a first position at which restricted communication is established therethrough in a direction from the first motor conduit to the second motor conduit, and a second position at which communication through the first shunt valve is blocked. A second shunt valve is connected between the first and second motor conduits and is movable between a first position at which restricted communication is established therethrough in a direction from the second motor conduit to the first motor conduit, and a second position at which communication through the second shunt valve is blocked. A first means is provided for moving the first shunt valve to its second position in response to the directional control valve being moved to the first position and a second means is provided for moving the second shunt valve to its second position in response to the directional control valve being moved to the second position.

The problem of having a continuous bypass of fluid between the motor conduits of a swing motor to obtain free swing of the upper body structure is solved by employing a pair of shunt valves interconnected between the motor conduits. The shunt valves are normally biased to a position wherein the first shunt valve provides restricted communication from the first motor conduit to the second motor conduit while the second shunt valve provides restricted communication from the second motor conduit to the first motor conduit. Both shunt valves are normally at their first position when the directional control valve is at its neutral position so that any inertia generated fluid pressure in either of the motor conduits can pass to the other conduit. However, when the directional control valve is shifted to drive the swing motor, the appropriate shunt valve is shifted to a blocking position to block fluid flow between the motor conduits.

BEST MODE FOR CARRYING OUT THE INVENTION

Figure 1:
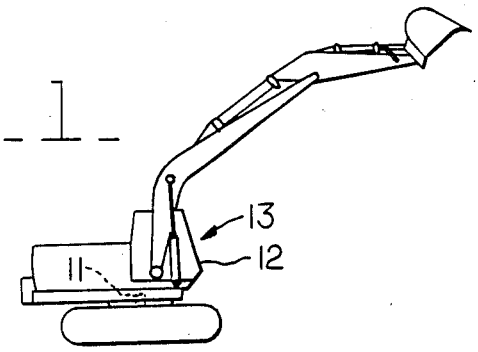
FIG. 1 is a side elevational view of an excavator embodying the principles of the present invention.
Figure 2:
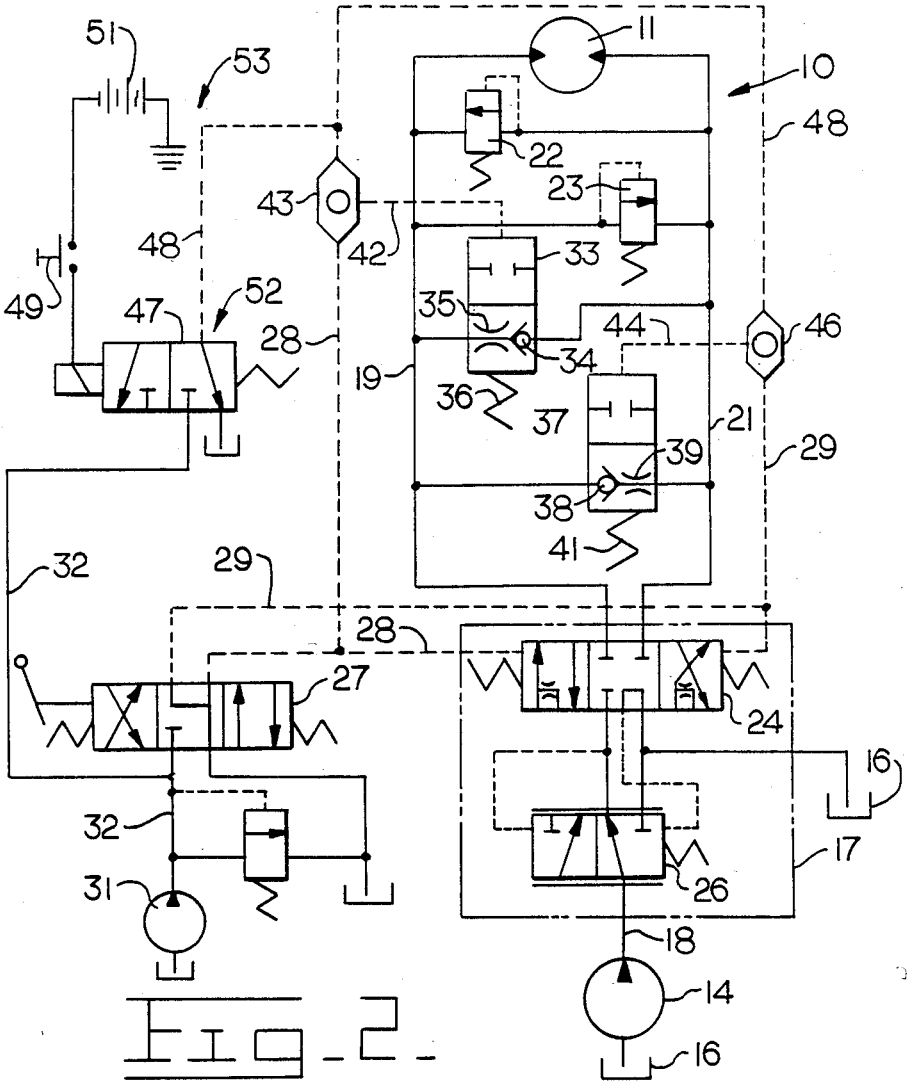
FIG. 2 is a schematic illustration of the embodiment of the present invention.

Referring now to the drawings, a hydraulic circuit generally indicated by the reference numeral 10 is provided for controlling a hydraulic swing motor 11 adapted to drivingly rotate an upper structure 12 of a hydraulic excavator 13. The hydraulic circuit 10 also includes a pump 14 connected to a tank 16, a pressure compensated directional control valve 17 connected to the pump 14 through a conduit 18, and first and second motor conduits 19,21 connecting the valve 17 to opposite sides of the hydraulic swing motor 11. A pair of cross line relief valves 22,23 interconnect the motor conduits 19,21 in the usual manner so that excessive pressure above a predetermined value in one of the first and second motor conduits is relieved to the other of the first and second motor conduits.

The pressure compensated directional control valve 17 includes a directional control spool 24 and a pressure compensated flow control spool 26 connected in series between the conduit 18 and the first and second motor conduits 19,21. The directional control spool 24 is spring centered to the neutral position shown and is movable to the right to a first position to direct pressurized fluid through the first motor conduit 19 to the motor 11. The directional control spool 24 is also movable to the left to a second position at which pressurized fluid is directed through the second motor conduit 21 to the motor 11. The flow control spool 26 functions in the usual manner to maintain a predetermined pressure differential across the directional control spool 24 at the first and second operating positions. Excess fluid from the pump 14 is bypassed by the flow control spool to the tank 16.

The directional control spool 24 is pilot operated and has its opposite ends connected to a manually actuated pilot control valve 27 through first and second pilot lines 28,29. The pilot control valve 27 is connected to a pilot pump 31 through a pilot supply line 32.

A first pilot operated shunt valve 33 is connected between the first and second motor conduits 19,21 and is movable between first and second positions. The shunt valve 33 includes a one-way check valve 34 and an orifice 35 which establish restricted communication through the shunt valve in a direction from the first motor conduit 19 to the second motor conduit 21 at the first position of the shunt valve. Communication between the first and second motor conduits is blocked by the shunt valve 33 at the second position of the shunt valve. A spring 36 resiliently urges the shunt valve 33 to the first position.

A second pilot operated shunt valve 37 is connected between the first and second motor conduits 19,21 and is also movable between first and second positions. The shunt valve 37 includes a one-way check valve 38 and an orifice 39 which establish restricted communication through the shunt valve 37 in a direction from the second motor conduit 21 to the first motor conduit 19 at the first position of the shunt valve 37. Communication between the first and second motor conduits is blocked by the shunt valve 37 at the second position thereof. A spring 41 resiliently urges the shunt valve 37 to the first position.

A pilot line 42 connects the end of the first shunt valve 33 with the first pilot line 28 through a resolver valve 43 and provides a means for moving the first shunt valve 33 to the second position in response to the directional control spool 24 being moved to the first position.

Another pilot line 44 connects the end of the second shunt valve 37 with the second pilot line 29 through a resolver valve 46 and provides a means for moving the second shunt valve 37 to the second position in response to the directional control spool 24 being moved to the second position.

A solenoid actuated valve 47 is connected to the pilot supply line 32 and to the resolver valves 43,46 through a pilot line 48. The solenoid actuated valve 47 is movable between a first position at which the pilot line 48 is communicated with the tank 16 and a second position at which the pilot supply line 32 is in communication with the pilot line 48. A manually actuatable switch 49 has one side connected to a source of electrical energy such as a battery 51 and its other side connected to the solenoid valve 47. The solenoid actuated valve 47, the pilot line 48 and the resolver valves 43,46 constitute a means 52 for simultaneously directing a fluid signal to both of the shunt valves 33,37. The means 52 and the switch 49 constitute a means 53 for selectively moving both the shunt valves 33,37 to their second position.

Industrial Applicability

In the operation of the control circuit 10 manually shifting the pilot valve 27 to the right directs pressurized pilot fluid through the first pilot line 28 as a first fluid signal to move the directional control spool 24 rightwardly to the first position. At the first position of the directional control spool 24, pressurized fluid is directed through the first motor conduit 19 to the swing motor 11 causing it to rotate in a first direction thereby rotating the upper structure 12 in a first direction. The pilot fluid signal in the pilot line 28 passes through the resolver valve 43 and through the line 42 to the first shunt valve 33 moving it to the second position. With the first shunt valve 33 at the second position communication therethrough between the first and second motor conduits is blocked. The check valve 38 of the second shunt valve 37 blocks fluid flow from the first motor conduit 19 to the second motor conduit 21. Thus, all the pressurized fluid entering the first motor conduit 19 is transmitted to the swing motor 11 and the fluid exhausted from the swing motor 11 passes through the directional control spool 24 and is returned to the tank 16.

When the operator wishes to stop rotation of the upper structure 12, the pilot valve 27 is returned to the neutral position. This allows the directional control spool 24 to return to its neutral position thereby blocking the pump from the first motor conduit 19 and the second motor conduit 21 from the tank 17. The inertia of the upper structure 12 acting on the swing motor 11 now causes the swing motor to act as a pump which tends to pressurize the fluid in the second motor conduit 21. However, since the second shunt valve 37 is in the first position, some of the fluid from the second motor conduit 21 passes through the orifice 39 and check valve 38 to the first motor conduit 19 and is recirculated through the motor 11. Moreover, if the fluid pressure in the second motor conduit 21 exceeds a predetermined value due to high inertia of the upper structure 12, the cross over relief valve 22 will also open to provide a second shunt path from the second motor conduit to the first motor conduit. In either case, as the inertia forces are dissipated the orifice 39 will allow the upper structure to coast to a stop in accordance with the size of the orifice 39.

Moving the pilot valve 27 to the neutral position as described above also allows spring 36 to return the shunt valve 33 to its first position. However, since the check valve 34 blocks flow of fluid from the second motor conduit 21 to the first motor conduit 19, movement of the shunt valve 33 to the first position has no effect on the above-described free swing of the upper structure 12.

It will be apparent that shifting the pilot valve 27 to the left shifts the directional control spool 24 and the shunt valve 37 to the second positions in response to a second fluid signal in the pilot lines 29 and 44. This causes the swing motor 11 to rotate the upper structure 12 in the opposite direction. It will also be apparent that the cross over relief 23 and shunt valve 33 will allow restricted communication from the first motor conduit 19 to the second motor conduit 21 similar to that described above when rotation of the upper structure 12 in the opposite direction is stopped and the swing motor 11 tends to pressurize the fluid in the first motor conduit 19.

The operator can selectively disable the free swing aspect of the control circuit 10 by closing the switch 49. This energizes the solenoid valve 47 moving it to the right. At the rightward position of the valve 47 pressurized pilot fluid passes therethrough and through the line 48, resolver valves 43 and 46, and the lines 42,44 to the first and second shunt valves 33,37, respectively. This moves both shunt valves to their second position thereby blocking intercommunication between the first and second motor conduits. The cross line relief valves 22 and 23 remain operational to intercommunicate the first and second motor conduits if the pressure in one of the motor conduits exceeds the predetermined value.

In view of the foregoing, it is readily apparent that the structure of the present invention provides an improved control circuit which provides limited free swing in bringing the upper structure to a stop. However, by actuating one of a pair of pilot operated shunt valves when the directional control spool is shifted to an operational position, communication between the first and second motor conduits is blocked so that the desired pressure and fluid flow can be directed to the swing motor under all swing motor drive conditions.

Other aspects, objects and advantages of this invention can be obtained from a study of the drawings, the disclosure and the appended claims.

I claim:

1. In a control circuit having a hydraulic motor, a pump, a directional control valve connected to the pump, and first and second motor conduits connecting the control valve with opposite sides of the hydraulic motor, said directional control valve being movable between a first position at which pressurized fluid is directed through the first motor conduit to the motor and a second position at which pressurized fluid is directed through the second motor conduit to the motor, said directional control valve having an intermediate position at which the first and second motor conduits are blocked from each other and from the pump, the improvement comprising;

a first shunt valve connected between the first and second motor conduits and being movable between a first position at which restricted communication is established therethrough in a direction from the first motor conduit to the second motor conduit and a second position at which communication through the first shunt valve is blocked;

first means for moving the first shunt valve to the second position in response to the directional control spool being moved to the first position;

a second shunt valve connected between the first and second motor conduits and being movable between a first position at which restricted communication is established therethrough in a direction from the second motor conduit to the first motor conduit, and a second position at which communication through the second shunt valve is blocked; and second means for moving the second shunt valve to the second position in response to the directional control valve being moved to the second position.

2. The control circuit as set forth in claim 1 wherein said first and second shunt valves are pilot operated and moved to their second position in response to receiving a pressurized fluid signal.

3. The control circuit of claim 2 wherein said directional control valve is pilot operated and is moved to the first position in response to a first fluid signal directed thereto and to the second position in response to a second fluid signal directed thereto, said first means including a line directing the first fluid signal to the first shunt valve, and said second means includes a second line directing the second fluid signal to the second shunt valve.

4. The control system as set forth in claim 3 including means for selectively moving both the first and second shunt valves to their second position.

5. The control circuit as set forth in claim 4 wherein said moving means includes means for simultaneously directing a fluid signal to both of said shunt valves.

6. The control circuit as set forth in claim 5 wherein said directing means includes a solenoid actuated valve and a line connected to the solenoid actuated valve and a pair of resolver valves positioned between the line and the first and second lines.

* * * * *